US006062272A

United States Patent [19]

Waite

[11] Patent Number: 6,062,272

[45] Date of Patent: May 16, 2000

[54] ABSORBENT TOWEL HAVING QUICK-DRY PROPERTIES

[75] Inventor: Carmen Lee Waite, Charlotte, N.C.

[73] Assignee: Springs Industries, Inc., Fort Mill, S.C.

[21] Appl. No.: 08/835,731

[22] Filed: Apr. 11, 1997

[51] Int. Cl.[7] ..... D03D 15/00; A42B 1/00; B32B 3/02

[52] U.S. Cl. ..... 139/420 A; 428/92; 428/253; 2/181; 2/237

[58] Field of Search ..... 139/420 A, 391, 139/392, 396, 404, 25; 428/78, 93, 13, 92; 604/378; 2/237, 181

[56] References Cited

U.S. PATENT DOCUMENTS

| | | |
|---|---|---|
| 3,721,274 | 3/1973 | Sherrill et al. . |
| 4,118,529 | 10/1978 | Nakagawa et al. . |
| 4,724,183 | 2/1988 | Heiman . |
| 4,920,000 | 4/1990 | Green . |
| 4,984,606 | 1/1991 | Moore et al. . |
| 5,084,322 | 1/1992 | Brioschi et al. . |
| 5,187,004 | 2/1993 | Risseeuw . |
| 5,312,667 | 5/1994 | Lumb et al. . |
| 5,336,543 | 8/1994 | Pyle . |
| 5,354,815 | 10/1994 | Barringer, Jr. et al. . |
| 5,408,012 | 4/1995 | Barringer, Jr. . |
| 5,495,874 | 3/1996 | Heiman . |

*Primary Examiner*—John J. Calvert
*Assistant Examiner*—Robert H. Muromoto, Jr.
*Attorney, Agent, or Firm*—Alston & Bird LLP

[57] ABSTRACT

A pile towel construction having quick-dry properties and good absorption characteristics is described. The towel includes a substantially all-cotton pile and a ground fabric which includes moisture-transporting polyester fibers. The towel desirably includes from about 10% to about 50% moisture-transporting polyester fibers. In one embodiment of the invention, the moisture-transporting fibers are provided in only one set of the ground fabric-forming yarns, such as the weft, while the other set of yarns forming the ground fabric is made from conventional polyester and/or cotton. In another form of the invention, the ground fabric is formed from substantially 100% moisture-transporting polyester fibers, while the pile is substantially all-cotton.

20 Claims, No Drawings

ABSORBENT TOWEL HAVING QUICK-DRY PROPERTIES

BACKGROUND OF THE INVENTION (1) Field of the Invention

The invention generally relates to an absorbent towel, and more specifically, to an absorbent, pile towel construction having quick-drying properties.

(2) Description of the Prior Art

Towels are generally woven on looms to include a ground fabric and an extra set of warp or filling yarns. The yarns of this extra set are interlaced with the ground warp and filling yarns to form a plurality of loops or cut ends which extend outwardly from one or both surfaces of the ground fabric to form a pile. The ground fabric is typically a plain weave construction. The various fiber or yarn inputs and/or the towel production process can be varied in order to produce towels having varied styles, levels of quality, patterns, and the like. For example, to achieve a towel having a pattern, the yarns fed to form the ground fabric and/or pile can be varied in color, luster, yarn size, etc., or the pile height can be varied in selected areas. Similarly, to vary the level of towel quality, the quality and size of the yarns woven can be varied, as well as the number of warp and filling ends. Likewise, other features of the input materials, such as the twist, type spun, etc., can be selected to determine the type of towel produced.

Because towels are generally used to dry other objects, they are customarily designed to be highly absorbent. To this end, towels have historically been manufactured from all or substantially all cotton yarns. While cotton has been found to be advantageous in many respects (i.e., it is absorbent, relatively durable, and generally available), it also presents several drawbacks. For one, cotton tends to shrink when exposed while wet to high temperatures such as those of a conventional hot dryer. In addition, while cotton is a good moisture absorber, it is less inclined to release the absorbed moisture. As a result, the drying time for cotton towels tends to be relatively long, and the thicker the yarns which are used to form the towels, the longer it typically takes them to dry. This slow drying is disadvantageous in several respects: not only does it result in increases in time between the instances when the towels can be used, but the slow drying encourages souring and mildew of the towels. Thus, consumers are often forced to buy towels which are less plush than they would prefer from an aesthetic (i.e., look and feel) perspective, in order to obtain a towel which will dry suitably quickly.

Various modifications to conventional 100% cotton pile towel constructions have been proposed to combat the problems associated with shrinkage. One such proposal is described in U.S. Pat. No. 3,721,274 to Sherrill, et al., which describes a towel construction with a reduced tendency to shrink. The towel has a base of interwoven sets of ground warp and filling yarns, with at least one of the sets of ground yarns being formed of a blend of cellulosic and 35–65% polyester fibers. Because the inclusion of the polyester reduces the absorbency of the fabric, in the preferred embodiment of the invention, the terry yarns forming one of the towel surfaces are absorbent rayon yarns, which are intended to make up for the absorbency loss caused by the inclusion of the polyester in the ground fabric.

Other commercially available towels include a percentage of polyester fibers in the ground fabric in order to reduce the tendency of the towel to shrink when convection dried. The percentage is generally limited to about 14% or less of polyester in the ground fabric, since amounts greater than that tend to adversely affect the absorbency of the towel.

One known commercial attempt to produce a towel having quick-drying capabilities is sold under the tradename AQUIS® and is manufactured by Teijin, Ltd. of Japan. This product is a flat weave double cloth which is made from a blend of wickable nylon fibers and polyester fibers. Because the towel does not contain cotton pile yarns, the comfort and "feel" properties generally associated with all-cotton towels are not provided. This product is extremely expensive to manufacture currently and is only used as a small hair towel.

Thus, a need exists for a towel which has a high rate of absorbency, quick drying capabilities, and a comfortable feel to a user.

SUMMARY OF THE INVENTION

With the foregoing in mind, it is therefore an object of the present invention to provide a towel construction having a high degree of absorption and quick-drying capabilities.

It is a further object to provide a towel construction having the appearance and comfort typically associated with conventional all-cotton towels.

It is also an object of the present invention to provide a towel construction having a high degree of absorption and quick-drying capabilities, and which can be manufactured using only a minimal number of production steps.

These and other objects are achieved by a towel construction having a ground fabric and a plurality of pile yarns extending outwardly from at least one surface of the ground fabric, and with the ground fabric comprising moisture-transporting polyester fibers. For purposes of the instant invention, the term "moisture-transporting polyester fibers" is used to describe those fibers having the ability to facilitate electrostatic movement of water molecules. In other words, such fibers have the ability to "excite" water molecules and transport them from one location to another. Examples of moisture-transporting polyester fibers which can be used in the invention are described in U.S. Pat. No. 5,354,815 to Barringer, Jr., et al. and U.S. Pat. No. 5,408,012 to Barringer, Jr., both of which are incorporated herein by reference. Such fibers are generally used primarily for thermal insulative purposes.

In one form of the invention, the moisture-transporting polyester fibers can comprise polyester polymers having a hydrophilic polysiloxane with an affinity for the polymer and a molecular weight greater than about 1000 g/mol bonded thereto. More specifically, a polyester polymer is desirably contacted with an aqueous treatment bath containing a hydrophilic polysiloxane under conditions which bond the polymer with the hydrophilic polysiloxane while avoiding polymerization of the polyester polymer with the hydrophilic polysiloxane, or the hydrophilic polysiloxane can be added in powder form to a polyester polymer melt. Alternatively, a hydrophilic copolymer comprising the reaction product of a primary hydroxylate having rewetting properties and a silane which has an affinity for the polyester polymer can be bonded to the polymer under conditions which provide bonding but not polymerization between the two. Such fibers are known to have increased hydrophilicity and thermal regulative properties over conventional untreated polyester fibers. However, such polyester fibers would generally not be expected to be as absorbent as cotton fibers. Thus, while such fibers have achieved niche uses in the thermal regulative environments, their use has not heretofore been appreciated in the absorbent articles market, due in part to the commercial acceptability and availability of known absorbent fibers such as cotton.

Surprisingly, however, it has been discovered that by utilizing such moisture-transporting fibers in the ground fabric of a cotton pile fabric construction, superior fabric drying can be achieved without a significant loss in towel absorption properties from that of a substantially all-cotton towel. Because the moisture transporting fibers are generally less absorbent than cotton fibers, one would expect substantially the same results through their use as would be obtained with conventional untreated polyester fibers. Unexpectedly, it has been found that when the moisture-transporting fibers are incorporated in the ground fabric of a substantially all-cotton pile fabric in the manner discussed further herein, the fibers serve to transport moisture absorbed by the pile across the width of the fabric. As a result, the ability of the cotton pile yarns to continue to absorb moisture is increased since they have less of a tendency to remain saturated. Because the ground fabric disperses the water as described rather than allowing it to be concentrated it in the area where it was absorbed, it has been found that such fabrics dry substantially quicker than those having all-cotton or polyester/cotton blended ground fabrics. Thus, the synergistic effect of the described combination of the moisture-transporting fibers with cotton yarns results in the formation of towels having an all-cotton feel while having quick-drying capabilities.

In one embodiment of the invention, the moisture-transporting fibers are provided in only one of the yarn sets forming the ground fabric (i.e., the warp or the weft), while in another embodiment of the invention, yarns in each of the warp and weft yarn sets are of the moisture-transporting variety. In each of these forms of the invention, the pile is substantially all-cotton, so that the "feel" and appearance of an all-cotton towel is provided. The moisture-transporting yarns generally form from about 10% to about 50% of the overall fiber content of the towel, and preferably from about 14% to about 30% thereof. This ability to incorporate such a high percentage of the moisture-transporting polyester fibers is particularly surprising since, as discussed above, the use of greater than 14% of conventional polyester fibers in the ground fabric of a pile fabric construction generally has an extreme adverse effect on the absorptability of the fabric, and thus is usually avoided.

Other objects, features and advantages of the present invention will become apparent from the following detailed description.

DETAILED DESCRIPTION

The absorbent towel of the present invention has quick-drying capabilities which are provided by incorporating moisture-transporting polyester fibers into the ground fabric of a pile fabric construction.

As discussed above, conventional towels and pile fabrics for producing towels and like articles generally include a woven ground fabric and a plurality of pile yarns extending outwardly from the fabric. because the towels are typically made from substantially all cotton fibers or to include a small percentage of polyester in the ground fabric, moisture absorbed by the pile yarns is transferred to underlying regions of the ground fabric, where it remains until it is evaporated from the towel. As a result, certain areas of a towel can be saturated or even over-saturated, while other areas of the towel remain dry.

In contrast, the towels of the present invention, through the use of a modified ground fabric construction, allow for the transport and distribution of moisture across the width of the ground fabric, and therefore across the width of the overall towel. Because the moisture is spread across a greater surface area of the ground fabric (and thus dispersed more thinly), it can be evaporated more quickly. As a result, the towel can dry more quickly than conventional all- or substantially all-cotton towels. (Though discussed specifically with respect to towels, it is noted that the term "towel" is intended to cover a variety of pile fabric articles, including but not limited to bath mats, wash cloths, dish towels, hair drying towels, and the like.)

The towel according to the present invention includes a woven ground fabric, which includes a set of warp yarns which are substantially parallel to each other and a set of weft or filling yarns which are substantially parallel to each other, with the warp and weft yarns being substantially perpendicular to each other. The yarns of each of the respective sets are periodically interlaced with the yarns of the other set, to form a woven fabric. The woven fabric desirably is of a plain or twill weave construction. A twill woven ground fabric is particularly preferred because it tends to be more durable and absorbent than that of a plain weave construction.

At least one of the sets of yarns forming the ground fabric (i.e., the warp or the weft) includes moisture-transporting polyester fibers. Such fibers are capable of "exciting" water molecules and wicking them from one location to another. In a preferred form of the invention, the moisture-transporting polyester fibers comprise polyester polymers having a hydrophilic polysiloxane with affinity for the polymer and a molecular weight greater than about 1000 g/mol bonded thereto. More specifically, a polyester polymer is desirably contacted with an aqueous treatment bath containing a hydrophilic polysiloxane under conditions which bond the polymer with the hydrophilic polysiloxane while avoiding polymerization of the polyester polymer with the hydrophilic polysiloxane. Alternatively, the hydrophilic polysiloxane can be added in powder form to a polyester polymer melt. Both of these methods are described in U.S. Pat. No. 5,354,815 to Barringer, Jr., et al. Alternatively, a hydrophilic copolymer comprising the reaction product of a primary hydroxylate having rewetting properties and a silane which has an affinity for the polyester polymer can be bonded to the polymer under conditions which provide bonding but not polymerization between the two.

In a particularly preferred form of the invention, one of the yarn sets forming the ground fabric includes moisture-transporting polyester yarns of the type sold under the tradename AKWATEK® by Comfort Technologies Inc. of Gastonia, N.C. Such yarns are commonly used in a thermal regulating capacity in apparel products. Because moisture-transporting fibers useful in performing the instant invention are commercially available in a substantially 100% moisture-transporting fiber yarn form (e.g., AKWATEK® yarns), in a preferred form of the invention, at least one of the ground fabric yarn sets (i.e., the warp or the weft) includes one or more yarns made from substantially all moisture-transporting fibers. In a particularly preferred form of the invention, both of the ground yarn sets, i.e., the warp and the weft yarn sets, are woven from yarns comprising substantially all moisture-transporting fibers, to provide a ground fabric comprising substantially 100% moisture-transporting fibers.

The towel also desirably includes a plurality of pile yarns extending outwardly from at least one surface of the ground fabric. These pile yarns are desirably formed as additional warp yarns interspersed between the ground warps and interlaced with the weft yarns so as to be tied into the ground fabric in a known manner. In a preferred form of the invention, the pile yarns are in the form of terry loops; alternatively, the pile yarns could be provided in the form of cut ends. Also in a preferred form of the invention, the pile yarns extend from both faces of the ground fabric, to form upper and lower pile faces on the towel.

The pile yarns are desirably substantially all cotton, in order that the feel of the towel of the instant invention is substantially the same as that of conventional all-cotton towels; alternatively, the pile yarns can include small quantities of other fibers such as polyester or rayon. In the event that the pile yarns are partially formed from fibers less absorbent than cotton, a corresponding decrease in the absorbency of the finished towel would be expected. Thus, a substantially all-cotton pile is preferred in order that the feel and absorbency of an all-cotton towel is obtained.

In one form of the invention, the towel includes at least about 10% of the moisture-transporting polyester fibers, and preferably at least about 14%; in a particularly preferred form of the invention, the towel includes at least about 30% moisture-transporting polyester fibers. Because it is desirable to make the pile from substantially all cotton fibers and the pile typically forms a substantial part of the overall towel, the moisture-transporting fibers generally comprise about 50% or less of the overall towel construction.

Within the above-stated parameters, where the ground fabric is made from less than substantially 100% moisture-transporting fibers, the remainder of the fibers used to make up the ground fabric are preferably either cotton, conventional polyester, or a combination thereof. It is particularly preferred that all-cotton be used for the rest of the ground fabric since, as noted above, the use of more than an insubstantial amount of conventional polyester can have a negative impact on the absorptiveness of the towel. Preferably, at least one of the ground fabric-forming yarn sets (i.e., the warp or the weft) is made from substantially 100% moisture-transporting polyester fibers. In a particularly preferred form of the invention, both of the ground fabric-forming yarn sets are substantially 100% moisture-transporting polyester fibers.

As described above, the moisture-transporting polyester yarns can form one or both of the yarn sets forming the ground fabric. Where the moisture-transporting yarns are provided in only one of the warp and weft yarn sets, it is preferred that the moisture-transporting yarns form the weft yarn set. Alternatively, the moisture-transporting yarns can form both the warp and weft yarn sets.

EXAMPLES

Example 1

A towel according to the instant invention was manufactured as follows:

A terry loop (warp pile) fabric was woven using 12/1 Ne AKWATEK® yarns to form the filling (i.e., weft), and 12/1 Ne cotton yarns to form the warp, while 13.50/1 Ne cotton yarns were used to form pile loops on both surfaces of the ground fabric using a terry pile ratio of 6.25. The resulting fabric had a fiber content of 14% AKWATEK® and 86% cotton.

Example 2

A terry loop (warp pile) fabric was woven using 12/1 Ne AKWATEK® yarns to form both the ground warp and filling, while 13.50/1 Ne cotton yarns were used to form pile loops on both surfaces of the ground fabric using a terry pile ratio of 6.25. The resulting fabric had a fiber content of 67% cotton and 33% AKWATEK®.

Example 3

A terry loop (warp pile) fabric was woven using 12/1 Ne AKWATEK® yarns to form the ground warp and filling and pile loops on both surfaces of the ground fabric in the same manner as described above with respect to Examples 1 and 2. The resulting fabric thus had a fiber content of 100% AKWATEK®.

Control

A 100% cotton control sample was produced in the same manner as Examples 1–3 and tested for absorbency using a slightly modified version of ASTM 5504.

Each of the towels of Examples 1, 2 and 3, which used the various ratios of AKWATEK® fibers to cotton fibers, was tested for moisture transport, convection drying, ambient drying, and absorbency. The 100% cotton control towel was also tested for the same parameters.

Moisture Transport

Moisture transport was measured as follows:

A 4"×4" square of 100% cotton was weighed and the dry weight recorded. The 4"×4" cotton sample was then folded twice to yield a 2"×2" dimension of material 4 layers thick. An 8"×8" piece of bathmat fabric was cut. The bathmat fabric was inserted onto a nailed board. (It is noted that a plastic picture frame and 4 inch PVC ring overlay could also be used.) 50 ml of water was then sprayed into the center of the bathmat while the board was on a flat surface, and allowed to sit for 10 minutes. After 10 minutes, the cotton sample was placed onto the center of the area where the water was applied, and covered by a 5 lb. weight. The weight was allowed to sit for 5 minutes, then was removed and the cotton sample weighed and the weight recorded.

Convection Drying

Convection Drying was measured as follows: Three 8"×8" samples were cut and the edges surged. The samples were conditioned overnight in the area where testing was to occur. The samples were then weighed, and the original weight recorded. The samples were then washed one time with soap at 120° F. Each sample was weighed as soon as it had finished being washed and the weight was recorded. The samples were then placed in a dryer, and drying was begun. The samples were removed from the dryer, one at a time, every 2 minutes, and the weights recorded; the samples were then returned to the dryer and the process repeated until the samples reached 97.5% of their original weight.

Ambient Drying

Ambient Drying was measured as follows: Three (3) 8"×8" samples were cut, and the edges surged. The samples were conditioned overnight in the area where testing was to take place. The samples were weighed, and the original weights recorded. Five (5) grams of water in a beaker were weighed, and a sample was submerged into the beaker, absorbing all of the water. Each sample was weighed again, and the weight and time recorded. The samples were then hung to air dry. For the first hour, the samples were weighed and the time recorded in minutes/seconds every ten minutes. For the next 30 minutes, the samples were weighed and time in minutes/seconds was recorded every 5 minutes. The samples were then weighed every 2 minutes, with the weight and time in minutes/seconds recorded until the samples had reached 97.5% of their original weight.

Absorbency

The absorbencies of the samples from Examples 1–3 and the control were measured using a modified version of the ASTM 5504 test method as follows:

500 ml of water were heated to 80° F. An 8"×8" square sample of the material was weighed dry, and the weight recorded. The sample was then placed at an angle 24 inches below a spray apparatus. The heated 500 ml of water was sprayed via the spray apparatus onto center of the sample. The sample was removed, put between two pieces of blotting paper and the top of the blotting paper was gently pressed or rolled across. The sample was then weighed, and the weight recorded. The dry weight was then subtracted from the wet weight and divided by the dry weight to get total wet pickup.

Each of the towels was compared to the 100% cotton control sample to determine the effect of the inclusion of the various amounts of moisture-transporting polyester fibers on the absorbency, moisture transport, convection drying, and ambient drying properties of the towels. The results of the comparisons are listed below in Table I.

TABLE I

| | 100% Cotton | 14% AKWATER ® 86% Cotton | 33% AKWATER ® 67% Cotton (Example 1) | 100% AKWATER ® |
|---|---|---|---|---|
| Moisture Transport %: as compared to cotton control | | 11% | 69% | 73% |
| Convection Drying %: tumble drying time as compared to cotton control | faster | 25% faster | 37% faster | 50% |
| Ambient Drying %: air drying time as compared to cotton control | faster | 16% faster | 30% faster | 37% |
| Absorbency % | 284% | 272% | 243% | 119% |

As illustrated above, the 100% cotton control towel had an absorbency of 284%. When the moisture transporting yarns were provided in the filling (Example 1), the absorbency was affected to only a slight degree, decreasing to 272%. However, the moisture transport percent was 11% higher than that of the cotton control, ambient drying was 16% faster, and convection drying was 25% faster. Thus, by using only about 14% of the moisture-transporting fibers (and by using moisture-transporting yarns to form only one of the ground yarn sets), a towel which can be convection dried 25% faster than an all-cotton towel is achieved, with the towel being only slightly less absorbent than the all-cotton counterpart.

Similarly, when the AKWATEK® yarns were used to form both the ground warp and filling, the moisture transport percent increased dramatically (to 69% higher than that of the all-cotton control), the convection drying time was 37% faster, and the ambient drying time was 30% faster; this all occurred with less than a 15% decrease in the absorbency from that of the all-cotton towel.

For purposes of comparison, a 100% AKWATEK® towel was produced (i.e., see Example 3.) Although moisture transport percent was 73% higher than that of the all-cotton towel, the moisture transport percent was only slightly greater than that which was achieved by the towel having a 100% AKWATEK® ground fabric and cotton pile (Ex. 2.) Further, although convection and ambient drying occurred significantly faster than the all-cotton and less-than-100% AKWATEK® towel constructions, the absorbency dropped to 119% in the 100% AKWATEK® towel. Furthermore, this towel lacked the "hand" of an all-cotton towel.

Thus, the most effective balance of absorptiveness and quick-drying was achieved when the ground fabric contained a percentage of moisture-transporting fibers and the pile was substantially all-cotton.

In the specification there has been set forth a preferred embodiment of the invention, and although specific terms are employed, they are used in a generic and descriptive sense only and not for purposes of limitation, the scope of the invention being defined in the claims.

That which is claimed is:

1. A quick-drying woven pile towel comprising a set of substantially parallel warp yarns and a set of substantially parallel weft yarns which are selectively interlaced with said warp yarns to form a ground fabric, and a plurality of pile yarns interlaced with the ground fabric and extending outwardly from at least one surface thereof, wherein at least one of said warp and weft yarn sets includes moisture-transporting polyester fibers and said pile yarns comprise substantially 100% cotton fibers, to thereby provide substantially the absorptiveness and feel of an all-cotton towel, with quick-drying capabilities.

2. The towel according to claim 1, comprising at least about 10% moisture-transporting polyester fibers.

3. The towel according to claim 2, wherein said towel comprises at least about 14% moisture-transporting polyester fibers.

4. The towel according to claim 3, wherein said towel comprises at least about 30% moisture-transporting polyester fibers.

5. The towel according to claim 2, wherein said ground fabric comprises less than 100% moisture-transporting polyester fibers, and further comprises fibers selected from the group consisting of cotton, polyester, and combinations thereof.

6. The towel according to claim 1, wherein only one of said warp and weft yarn sets includes moisture-transporting polyester fibers.

7. The towel according to claim 6, wherein said weft yarns comprise moisture-transporting polyester fibers.

8. The towel according to claim 1, wherein each of said warp and weft yarn sets comprises substantially all moisture-transporting polyester fibers.

9. The towel according to claim 1, wherein said set of ground warp yarns comprises about 50% polyester and 50% cotton fibers, and said set of weft yarns comprises substantially all moisture-transporting polyester fibers.

10. The towel according to claim 1, wherein said moisture-transporting polyester fibers comprise polyester polymers having a polysiloxane with an affinity for the polymer and a molecular weight greater than about 1000 g/mol bonded thereto.

11. The towel according to claim 1, wherein said moisture-transporting polyester fibers comprise a polyester polymer having a hydrophilic copolymer including the reaction product of a primary hydroxylate having rewetting properties and a silane having an affinity for the polyester polymer bonded to the polymer under conditions which provide bonding but not polymerization between the two.

12. The towel according to claim 1, wherein said pile yarns are in the form of terry loops.

13. A quick-drying, absorbent woven pile fabric comprising a ground fabric defined by interwoven sets of warp and weft yarns and a plurality of substantially all-cotton pile yarns interwoven with the ground fabric and extending outwardly from at least one surface thereof in the form of terry loops, wherein said ground fabric includes moisture-transporting polyester fibers in a quantity sufficient to form at least about 10% of the overall pile fabric structure, and wherein moisture absorbed by said terry loops has a tendency to be transported across said ground fabric by way of said moisture transporting polyester fibers.

14. The fabric according to claim 13, wherein said fabric comprises at least about 14% moisture-transporting polyester fibers.

15. The fabric according to claim 14, wherein said fabric comprises about 30% moisture-transporting polyester fibers.

16. The fabric according to claim 13, wherein one of said warp and weft yarn sets consists essentially of moisture-transporting fibers.

17. The fabric according to claim 13, wherein said ground fabric consists essentially of moisture-transporting fibers.

18. The fabric according to claim 13, wherein said moisture-transporting polyester fibers comprise polyester polymers having a polysiloxane with an affinity for the polymer and a molecular weight greater than about 1000 g/mol bonded thereto.

19. The fabric according to claim 13, wherein only one of said warp and weft yarn sets comprises moisture-transporting fibers.

20. The fabric according to claim 19, wherein said weft yarn set comprises moisture-transporting fibers.

* * * * *

UNITED STATES PATENT AND TRADEMARK OFFICE
CERTIFICATE OF CORRECTION

PATENT NO. : 6,062,272

DATED : May 16, 2000

INVENTOR(S) : Waite

It is certified that error appears in the above-identified patent and that said Letters Patent is hereby corrected as shown below:

Title page, [56] References Cited, U.S. PATENT DOCUMENTS, insert the following:

--5,290,269 3/1994 Heiman 5,667,865 9/1997 Jackson et al.

5,745,921 5/1998 Mitchell et al.

4,530,873 7/1985 Okada 5,297,296 3/1994 Moretz et al.--.

Title page, [56] References Cited, insert the following:

--FOREIGN DOCUMENTS

JA-0015538 1/1984 Japan--.

Column 7, in Table I, "AKWATER", three occurrences, should read --AKWATEK--.

Column 7, in Table I, the word "faster", six occurrences, should appear under the percentage numbers (incorrect indentations).

Signed and Sealed this

Tenth Day of April, 2001

*Attest:*

Nicholas P. Godici

NICHOLAS P. GODICI

*Attesting Officer*

*Acting Director of the United States Patent and Trademark Office*